United States Patent [19]

Moog

[11] 4,050,343

[45] Sept. 27, 1977

[54] ELECTRONIC MUSIC SYNTHESIZER

[75] Inventor: Robert A. Moog, Williamsville, N.Y.

[73] Assignee: Norlin Music Company, Lincolnwood, Ill.

[21] Appl. No.: 644,864

[22] Filed: Dec. 29, 1975

Related U.S. Application Data

[63] Continuation of Ser. No. 396,323, Sept. 11, 1973, abandoned.

[51] Int. Cl.[2] ..... G10H 1/00

[52] U.S. Cl. ..... 84/1.01; 84/1.24; 84/1.13; 84/1.19; 84/1.26

[58] Field of Search ..... 84/1.01, 1.03, 1.24, 84/1.26, 1.13, 1.17, 1.19

[56] References Cited

U.S. PATENT DOCUMENTS

| | | | |
|---|---|---|---|
| 3,549,776 | 12/1970 | Shiga et al. | 84/1.03 |
| 3,787,601 | 6/1974 | Campbell | 84/1.03 |
| 3,828,110 | 8/1974 | Colin | 84/1.24 X |
| 3,861,263 | 1/1975 | Okudaira | 84/1.03 X |

*Primary Examiner*—Ulysses Weldon

*Attorney, Agent, or Firm*—LeBlanc & Shur

[57] ABSTRACT

An electronic music synthesizer is disclosed in which the sound producing chain includes a voltage-controlled oscillator, band-pass filter, low-pass filter, and amplifier in which selected control currents are supplied to low impedance points within the synthesizer circuit from a resistor matrix. The synthesizer produces sounds approximating different acoustic musical instruments or having different tonal qualities by the application of a predetermined voltage to one of fifteen input columns of the resistor matrix with selected other columns being grounded. The currents provided by the resistor matrix in combination with other externally generated currents control the center frequency and bandwidth of the band-pass filter, the cutoff frequency of the low-pass filter, the gain of the voltage-controlled amplifier, the time constants of transient contour currents used to control the filters and amplifier, and the waveform produced by the voltage-controlled oscillator. Specialized keyboard, waveshaping, contour generating and modulating circuits are also provided.

12 Claims, 10 Drawing Figures

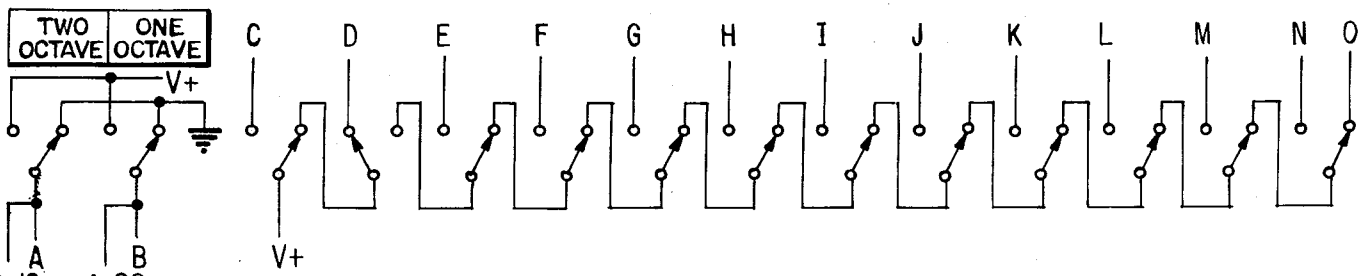

FIG. 2

FIG. 3 RESISTOR MATRIX

| | 2 OCT A | 1 OCT B | C | MUTE | OPEN D | THIN E | HOLLOW F | FULL G | BRIGHT H | BOW I | PLUCK J | STRIKE K | PICK L | BELL M | LUNAR N | FLUTE O |
|---|---|---|---|---|---|---|---|---|---|---|---|---|---|---|---|---|
| 1 VCA ATTACK | 1 MEG | 2.2 MEG | 2.2 MEG | 300 K | 270 K | 370 K | 470 K | 370 K | 370 K | 2.2 MEG | 100 K | 100 K | 100 K | 240 K | 240 K | 1.5 MEG |
| 2 VCA DECAY | 1 MEG | 2.2 MEG | 300 K | 230 K | 300 K | 300 K | 300 K | 300 K | 300 K | 270 K | 620 K | 1.5 MEG | 230 K | | 820 K | 300 K |
| 3 SUST - DECAY | | | | 330 K | 330 K | 330 K | 330 K | 330 K | 330 K | 330 K | 330 K | 330 K | 330 K | | | |
| 4 INACTIVATE KB CONTROL OF C.F. | | | | 330 K | 330 K | 330 K | 330 K | 330 K | 330 K | 330 K | | | 330 K | | | 330 K |
| 5 VCF CONTOUR ROUTING | | | | 330 K | | 200 K | 100 K | 130 K | 200 K | | 200 K | | | 100 K | 330 K | 330 K |
| 6 WAVE FORM | | | | | | | | | | | | 820 K | | 100 K | 180 K | 100 K |
| 7 C.F. | | | | | | 185 K | 174 K | 205 K | 135 K | 174 K | 158 K | 205 K | 254 K | 254 K | 1.5 MEG | |
| 8 BAND WIDTH Q | | | | | | 1% | 1% | 1% | 1% | 1% | 1% | 1% | 1% | 1% | 1% | |
| 9 L.P. CUTOFF | | | | | | 185 K | 390 K | 430 K | 270 K | 100 K | 100 K | 100 K | 620 K | 300 K | | 300 K |
| 10 VCF ATTACK | | 1.0 MEG | 2.2 MEG | 240 K | 510 K | | 2.2 MEG | | 1 MEG | 240 K | 270 K | 470 K | 360 K | 680 K | 190 K | 360 K |
| 11 VCF CONTOUR SELECT | | 1.0 MEG | 2.2 MEG | 1.0 MEG | 360 K | 620 K | 620 K | 430 K | 270 K | 100 K | 100 K | 100 K | 100 K | 100 K | 330 K | 750 K |
| 12 VCF DECAY | | 1.0 MEG | 2.2 MEG | 220 K | 200 K | 160 K | 160 K | 220 K | 330 K | 130 K | 470 K | 560 K | 300 K | 1.5 MEG | 330 K | 330 K |

ELECTRONIC MUSIC SYNTHESIZER

This is a continuation of application Ser. No. 396,323, filed Sept. 11, 1973, now abandoned.

This invention relates to the electronic production of music and more particularly to an electronic music synthesizer of great versatility which may be used both in the composition of music and in the performance of a musical composition.

While electronic music producing instruments such as the electric guitar and the electric organ have been utilized extensively for the production of music, the electronic production of music by the simulation of a variety of different instruments presents the composer of electronic music with a different problem. Not only must the composer write a score, he must also synthesize the instruments or the tonal qualities he wants for the performance of his work. This requires electronic apparatus with a wide variety of "voices" as opposed to single-voiced instruments such as the electronic organ or guitar.

In the realization of a musical composition by use of completely electronic apparatus, it is oftentimes necessary in addition to the pitch, amplitude and duration of a note that a number of other factors be controlled in order that the sound eventually produced approximates the sound made by the instrument or effect which the composer has in mind. For a given instrument, in addition to pitch, amplitude and duration, the growth and the decay characteristics of the instrument must be analyzed, so that the sound produced by the electronic sound producing chain of the synthesizer will approximate the response of the instrument when it is played. For instance, taking a flute as an example, the production of a single note requires that a certain air volume be going through the instrument and that its resonant chamber be of a certain length in order to produce a note of a certain pitch. In order to produce this note, however, keys must be actuated and the actuation is not instantaneous. For instance, as a hole on the flute body is covered by a finger coming down on the hole, the pitch of the instrument is changed not instantaneously, but over a finite period of time. Not only does the pitch change during the production of a note, but the amplitude as well does not rise instantaneously upon the musician's playing of a note. Thus in order for the sound produced by the electronic apparatus to approximate the sound of a flute, one factor is the growth and decay not only of the amplitude of the sound produced by the instrument, but also the frequency response of the instrument.

The growth and decay characteristics of the instrument are only some of many characteristics which must be analyzed in order to produce a life-like sound. Other characteristics include harmonic overtones or lack thereof and in general the spectral response of the instrument. Spectral analysis of instruments is, however, not enough to permit the composer of electronic music to provide a life-like performance since if spectra alone are used, a pure and rather sterile sounding composition results. A true electronic music synthesizer must therefore provide for what is usually called "tone color" in which the sounds produced are bright, full, hollow, thin, open, mute or approximate the percussive sounds of the picked, struck or plucked instrument. It will be readily appreciated that the electronic music synthesizer is considerably more than an electronic organ, which provides a minimum amount of control over the parameters of the musical sounds.

As mentioned, in order for a musical composition to be realized on an electronic music synthesizer, the composer decides not only the musical composition which is to be performed, but also what "instruments" are to perform the musical composition. It will be appreciated that the composer may also select specialized effects which only an electronic music synthesizer can produce. However, for the production of "classical" music as that term is commonly understood (not only to include classical compositions but also any composition which is played by standard musical instruments), each instrument is separately synthesized by the recording of its part onto an electromagnetic tape. This is accomplished in much the same way as parts are written for individual instruments in an orchestra. After each instrument has been synthesized and its part has been "played" onto a tape, all the tapes are simultaneously played to generate the entire musical composition.

One of the first of the electronic music synthesizers was the RCA electronic sound synthesizer located at the Columbia-Princeton Electronic Music Center. In this synthesizer a bank of oscillators produce pure tones which are later altered by passive components in the form of filters having predetermined characteristics. In the course of synthesizing music, these filters are switched in series with the particular oscillator output signal desired in order to provide a signal of the required tone quality. The RCA Electronic Sound Synthesizer embodies, however, a large bank of oscillators, a large number of pretuned passive elements, and a complex and sophisticated switching network for appropriately switching the passive components in and out. In addition to the size and expense of the passive component switching system, switching transients often degrade the quality of the music produced.

The passive system was initially superceded by a variety of hybrid electronic music synthesizers including laboratory test oscillators, white-noise generators, and filters, as well as commercial audio mixers, patch panels, and recorders. In addition, variable gain amplifiers and assorted modulating devices were built from designs based on circuitry originally developed for communications equipment.

In order to work with such equipment, the composer carefully and patiently sets the operating parameters of each instrument (e.g., frequencies of the oscillators, bandwidth of the filters, etc.) to achieve the desired sound and then recorded the sound. The segments of tape containing the sounds were then spliced together, one at a time, to produce the finished composition. This method of composition is now called "classical studio technique."

The classical studio technique has the advantage that the composer can easily understand and master the processes involved. These include electronic tone and white-noise generation, filtering, modulating, amplitude control, reverberation and tape manipulation. However, classical composition tends to be tedious and time-consuming. Moreover, it is difficult to produce complex, dynamically varying sounds with conventional laboratory and commercial audio equipment.

It has now been found that the consistent and systematic use of voltage-controlled instruments simplifies both the generation of complex, dynamically varying sounds and the arrangement of these sounds into the composition. A voltage-controlled instrument has one or more operating parameters determined by the magnitude of applied control voltages rather than by the settings of panel controls. It is generally easier to change the voltage rapidly and precisely than it is to reset panel controls with equal speed. Additionally, the problems of changing the operating parameters of the instruments are reduced to the simple problem of changing the control voltages determining the values of parameters. Of course, in order to take full advantage of the benefits of voltage control, controlled instruments must have a fast speed of response and an accurate relationship between the magnitude of the control voltage and the controlled parameter.

Three important classes of voltage-controlled instruments are commonly used in the electronic synthesis of music: oscillators, filters and amplifiers. A voltage controlled oscillator (V.C.O.) produces audio signals whose pitch is determined primarily by the frequency of osciallation and whose tone colors are determined by the waveforms and types of frequency modulation employed. V.C.O.'s may also be used as control voltage generators to periodically modulate other voltage controlled devices. Finally, timing of musical events may be achieved by using the output of a slowly oscillating V.C.O. to trigger or initiate the events. With the use of high quality V.C.O.'s, several control inputs may be provided so that more than one type of frequency variation may be accomplished simultaneously. For instance, a slowly varying periodic voltage may be applied to one control input while the voltage of another input is stepped in fixed increments. The resulting output will then be a musical scale with vibrato (frequency modulation). In general, a sawtooth waveform from the oscillator is extremely useful in synthesizing musical sounds, since it contains all the integral harmonics of the fundamental frequency of oscillation. Subsequent filtering which attenuates some harmonics and boosts others imparts one of a variety of tone colors to the signal. However, additional wave shaping may be employed to change the sawtooth waveform into entirely different waveforms.

Three other waveforms which are musically useful are the sine, triangular and rectangular waves. The sine wave ideally contains no harmonics other than the fundamental frequency. Its sound lacks brightness and, in terms of harmonic structure, is simplest of any signals. The harmonic content of the triangular wave is only twelve percent of the total and consists entirely of the odd harmonics. Its sound is muted and hollow like that of a flute. Finally, the spectrum of the rectangular waveform depends upon the relative widths of the positive and negative portions of the wave, but it is characterized by the absence of certain harmonics within the spectrum. For instance, when the positive and negative portions of the wave are of equal width (i.e., when the waveform is a square wave), then all the even harmonics drop out, and the spectrum consists only of odd harmonics. Rectangular waveforms may be used in synthesizing a wide variety of orchestral colors, from the violin to the clarinet, depending upon the relative widths of the two parts of the waveform.

Additionally, when a number of differing waveform outputs are available simultaneously, additional timbral effects may be achieved by mixing two or more waveforms.

After frequency and duration, amplitude is the most important musical parameter. A voltage-controlled amplifier (V.C.A.) capable of varying the amplitude of an audio or control voltage may be utilized to approximate the growth and decay curves of varous instruments. With balanced amplifiers, rapid gain changes can be effected without common mode level shifts appearing in the output. This is especially important in synthesizing percussive sounds or other sounds which change rapidly in level. In addition, the V.C.A. may be entirely direct coupled so that slow moving control signals as well as audio signals can be produced.

The next most important instrument is the voltage controlled filter (V.C.F.). These filters often take the form of a band-pass filter in which the center frequency and bandwidth are voltage-controlled, or take the form of a low-pass filter in which the cutoff frequency is controlled. With voltage-controlled filters, rapid, precise change in overtone content can be achieved.

As with any voltage-controlled device, the control voltage may vary in a variety of manners or ways. Taking the voltage-controlled oscillator, for instance, assuming that the oscillator frequency is determined by the control voltage, it will be apparent that the oscillator output signal may be given a variety of tonal colors. For instance, by rapidly varying the control voltage a certain amount of vibrator can be added to the tone produced. A slowly varying control voltage can slide the oscillator to the appropriate pitch in much the same way that the pitches are attained in a wind instrument when, for instance, a human finger approaches an open hole at first partially occluding the hole and then completely occluding it to produce the particular note. This is referred to as "glide."

With respect to the band-pass filter, its center frequency can be moved as the note is being produced. This same effect is accomplished by changing the control voltage to the low-pass filter such that the cutoff frequency rises and falls during the production of a particular note. The pattern of rising and falling of the frequency response of the filter is called "the filter contour." As an example of the use of filter contouring, in the synthesizing of a trombone sound, it is essential that the sound starts off with low harmonic content. This is produced by applying a rising control voltage to a low-pass voltage-controlled filter so that the filter first allows through only the fundamental of a waveform of high harmonic content and then allows through other harmonics. Conversely, the sound of a plucked string (for instance a guitar sound) is synthesized by beginning with a tone of high harmonic content and then rapidly reducing the amplitudes of the harmonics. A falling transient control voltage is applied to the voltage controlled filter in order to produce this effect.

In addition to transient control voltages which determine the contour of a filter, e.g., the response of the filter during the production of a note, periodic control voltages (from oscillators) are useful in imparting frequency modulation (vibrato, trill and other less conventional effects), not only to the voltage-controlled oscillator (V.C.O.) but also the voltage-controlled filter (V.C.F.). Thus a tremelo may be imparted to the audio signal by rapidly sweeping the filter in a repeated fashion. A similar effect can also be achieved in connection with the voltage-controlled amplifier.

The voltage-controlled amplifier may also be provided with an amplitude contour corresponding to the rise and fall time or decay time of the instrument to be synthesized. In some instruments the rise or attack time in the production of a musical note is very fast, such as in the plucking or striking of a string. On the other hand, the rise time for wind instruments is relatively slow. In order to synthesize a wind instrument the amplitude is made to slowly rise and then to slowly fall preferably in an exponentional manner. It will be appreciated that an exponential decay curve contour can be generated by the production of an exponential control voltage.

Musical notes or tones are thus produced either by the use of slowly varying or rapidly varying regular control-voltage patterns. If the control voltage changes rapidly and regularly, sounds are produced which are perceived as having characteristics which are relatively complex rather than having simple distinct parameter changes. Slowly varying control voltages result in the more simple distinct changes in musical parameters. The sounds from a truly versatile synthesizer may have either simple or complex changes induced by these two kinds of control voltages. Control voltages for an electronic music synthesizer may, in summary, be given predetermined contours for producing predetermined effects. It will be appreciated that in addition to accurately synthesizing the sounds produced by conventional musical instruments, the control voltages in combination with the voltage-controlled instruments can produce a variety of special effects which produce sounds not capable of being produced by any known musical instrument.

Accordingly, a versatile, easily used electronic music synthesizer is provided. The synthesizer utilizes a sound producing chain including a voltage-controlled oscillator, band-pass filter, low-pass filter, and amplifier. Control of these elements is achieved through currents which are supplied from a resistor matrix. The synthesizer is made to produce sounds approximating different acoustic musical instruments or having different tonal qualities by the application of a predetermined voltage to one of 13 "voice" input columns of the resistor matrix, and the grounding of the other twelve. The remaining two columns are associated with the instrument's pitch range, and are independent of the "voice" columns.

The resistor matrix output rows are connected to low impedance points within the synthesizer so that a single resistor between an input column and an output row provides a required current into the low impedance control point to which the row is connected. Additionally, the application of the predetermined voltage to either or both of the "pitch range" input columns enables the synthesizer to handle a one or two octave shift in pitch. A low impedance (typcially 1,000 ohms) control input is associated with each voltage-controlled parameter. A control voltage proportional to the sum of all control currents flowing into a given control input therefore appears across said input.

The currents provided by the resistor matrix in combination with other control currents determine the center frequency and bandwidth of the band-pass filter, the low-pass cutoff of the low-pass filter, the time constants of the filtering and the amplification contour voltages, and the waveform produced by the voltage-controlled oscillator.

The oscillator, the band-pass filter, the low-pass filter and the voltage-controlled amplifier are controlled from respective control circuits which are in turn controlled either directly from matrix generated currents, from currents supplied by contour generators, which themselves receive control currents from the resistor matrix and from externally generated currents.

The electronic music synthesizer of the subject invention also employs specialized keyboard, oscillator, band-pass filter, and contour voltage generating circuits which enable the production of a large variety of tones and tonal colors simply and with a minimum time spent by the musician.

It is accordingly an object of this invention to provide a versatile electronic music synthesizer.

It is also an object of this invention to provide a novel method and apparatus for generating predetermined musical sounds.

It is still a further object of this invention to provide specialized keyboard, oscillator, and contour voltage generating circuits for an electronic music synthesizer which contribute to its versatility and minimize certain problems in the synthesis of electronic music.

It is another object of this invention to provide an electronic music synthesizer with voltage-controlled sound producing elements and an improved master control circuit which permits the accurate synthesis of a wide variety of different musical instruments.

It is yet another object of this invention to provide both a voltage-controlled band-pass filter having a variable bandwidth and center frequency and a voltage-controlled low-pass filter having a variable cutoff frequency, in the sound producing chain of an electronic music synthesizer.

It is a further object of this invention to provide an electronic music synthesizer having voltage-controlled elements in which the control voltages are contoured in a predetermined manner to produce a predetermined sound.

It is a still further object of this invention to provide a resistor matrix for use in the production of control currents which are applied to low impedance points in a control circuit for an electronic music synthesizer such that the application of a predetermined voltage to one column of the resistor matrix results in the generation of predetermined control currents applied to voltage-controlled elements in the sound producing chain of electronic music synthesizer.

It is yet another object of this invention to provide an electronic music synthesizer with a voltage-controlled oscillator and function generator, a voltage-controlled band-pass filter, a voltage-controlled low-pass filter, and a voltage-controlled amplifier, in which the center frequency and bandwidth of the band-pass filter, the cutoff frequency of the low-pass filter, the oscillator pitch and waveform, and the contour time constants are controlled responsively to the currents generated in a resistor matrix by the application of a predetermined control voltage to one of the columns of the matrix.

It is yet another object of this invention to provide an electronic music synthesizer utilizing a resistor matrix to generate a series of control currents having predetermined relationships in which the output currents from the resistor matrix are summed with other preselected currents applied in parallel therewith to low impedance points within the electronic synthesizer circuit.

These and other objects and advantages will become more readily apparent upon reference to the following specification and appended drawings wherein:

FIG. 2 is a schematic diagram of the switching unit for the resistor matrix of FIG. 1;

FIG. 3 is a schematic diagram of the resistor matrix;

Figure 1:
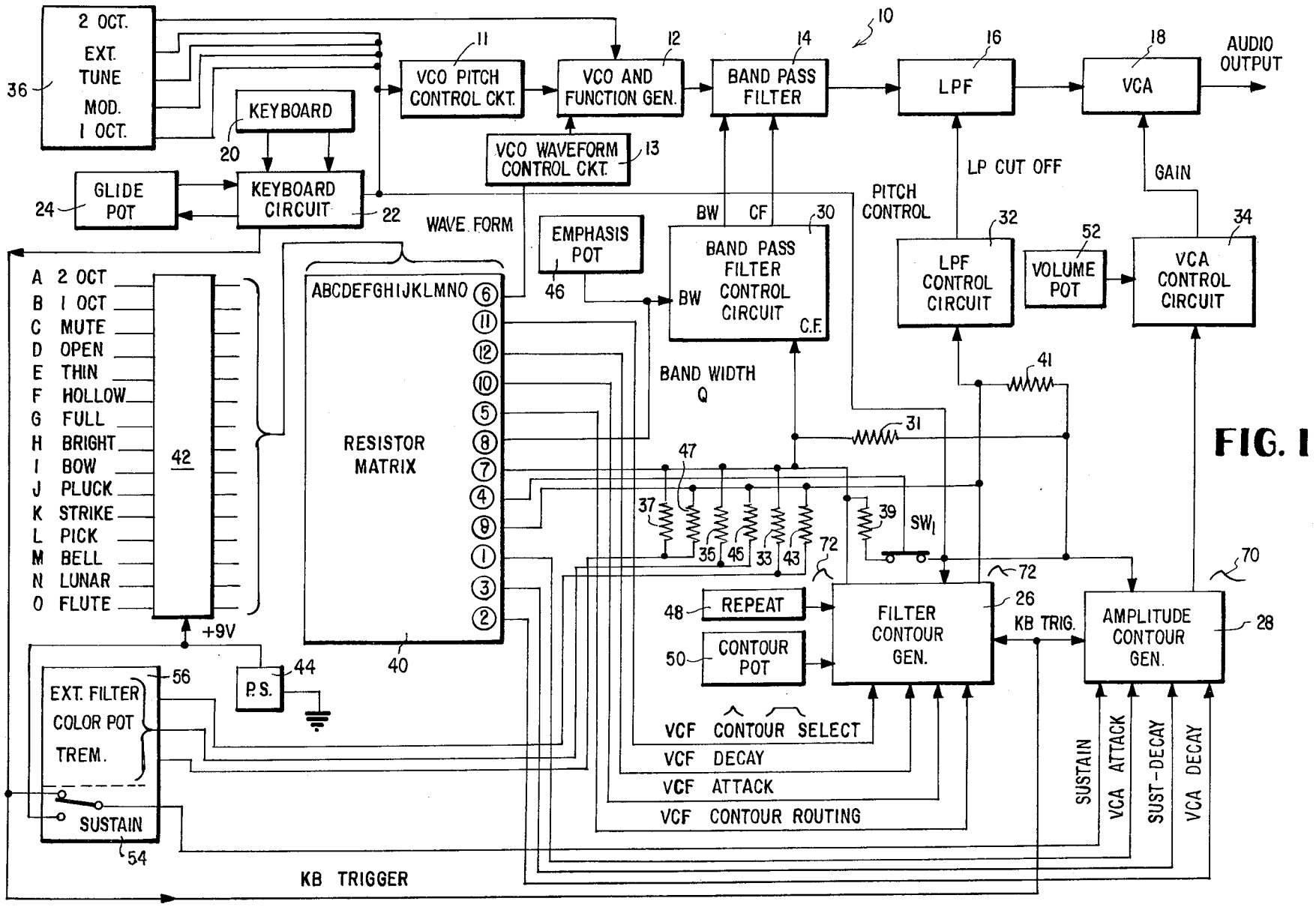
FIG. 1 is a block diagram of the subject electronic music synthesizer illustrating a sound producing chain of voltage-controlled elements and a control circuit therefor.

Referring now to FIG. 1, an electronic music synthesizer 10 is illustrated as including a sound producing chain including a voltage-controlled oscillator (V.C.O.) and function generator 12, a voltage-controlled band-pass filter 14, a voltage-controlled low-pass filter 16, and a voltage-controlled amplifier (V.C.A.) 18, all connected in series.

A keyboard 20 is connected to a keyboard circuit 22. In general, keyboard 20 utilizes a standard set of keys corresponding to notes of a musical scale and generates a voltage proportional to and indicative of the note being played. The keyboard includes a single string of resistors with the appropriate note being indicated by the sensing of a change in potential (the voltage drop) across the entire string.

Keyboard circuit 22 provides a voltage proportional to the pitch desired, and includes circuitry which removes the effects of contact bounce from the operation of the synthesizer. A glide control circuit 24 is coupled to keyboard circuit 22 for control of the guide characteristic of the notes generated by the keyboard circuit.

A one-octave shift, modulating, tuning and an external jack voltage may be added to or subtracted from the pitch-related voltage produced by the keyboard circuit 22. These voltages are generated externally as indicated by circuit 36. Pitch-determining signals are summed by V.C.O. pitch control circuit 11 and then applied to the V.C.O. Additionally, a two-octave signal from circuit 36 may be applied directly to the V.C.O. and function generator 12 for the production of a two-octave shift in the output signal from the oscillator.

When a key is depressed, a keyboard pitch signal is generated. This pitch voltage is held by circuit 22 until a new key is depressed. Thereupon, oscillator 12 proceeds to produce a signal having a frequency corresponding to the depressed key. This signal is routed through the band-pass filter 14, the low-pass filter 16 and the voltage-controlled amplifier 18 where the pure oscillator signal is treated and altered in accordance with various control voltages. The output signal is an audio signal which is amplified and fed directly to a speaker or other audio reproduction device. Alternatively, the audio signal is tape recorded for use in providing the finished composition.

In the modification of the oscillator signal, both the center frequency and bandwidth of bandpass filter 14 are controlled by control currents generated by band-pass filter control circuit 30. Control currents which determine the net control voltages at the center frequency input of 30 come from the keyboard pitch signal through resistor 31, from a filter contour generator 26, from a resistor matrix 40, and from external filter, color pot and tremolo control voltages 56, which are fed through resistors 33, 35, and 37, respectively. Additional control current from the keyboard pitch voltage flows through resistor 39 when switch SW1 is closed. The control currents which determine the net control voltage at the bandwidth control input of 30 come from emphasis pot 46 and resistor matrix 40.

The cutoff frequency of low-pass filter 16 is controlled by the control current generated by low-pass filter control circuit 32. Control input currents which determine the net control voltage at the input of 32 come from the keyboard pitch signal through resistor 41, from filter contour generator 26, from resistor matrix 40, and from external filter, color pot and tremolo control voltages 56, which are applied through resistors 43, 45 and 47, respectively.

The filter contour and amplitude contour generators are controlled by the pitch signal, the resistor matrix 40 and a keyboard trigger signal which triggers the production of a contour current to be applied to the filters and amplifiers. Additionally, filter contour generator 26 is triggered by an externally generated voltage from a repeat unit 48, and is controlled by contour pot 50. Amplitude contour generator 28 is also controlled by a sustain key 54.

CONTOURING

Upon actuation of a keyboard key, keyboard circuit 22 produces a pitch signal and a trigger signal. The trigger signal is provided for triggering filter contour generator 26 and amplitude contour generator 28 to produce the contour dictated by the pitch signal and both matrix generated and generally generated control currents. The currents from the contour generators are applied to respective elements in the sound producing chain for creating dynamic sound parameter variations.

It will be appreciated that for each note the center frequency of the bank-pass filter may be appropriately set responsive to the keyboard key depressed. Thus, by closing switch SW1, the band-pass filter may be made to track the fundamental frequency of the note being played. Additionally, appropriate contouring is superimposed. Likewise, the growth and decay characteristics of the contour generators 26 and 28 are made to depend upon the pitch signal. Thus, in the production of high frequency or high pitched sounds where the growth and decay curves are generally shorter, appropriated controuring is achieved.

The signal from amplifier control circuit 34 which controls the gain of amplifier 18 may be made to increase to a predetermined level, and then decrease; or increase, remain steady and decrease to obtain a sustained note, depending on the amount of sustained-decay current from matrix 40. The audio output signal amplitude tracks this control signal. The rate of increase and decrease is controlled such that there is a predetermined amplitude vs. time "contour" for the amplitude of the audio output signal. One such contour is illustrated by waveform 70 of FIG. 1. This contour has a relatively short linear rise time and a long exponentially curved decay time. Both the rise time and the decay time are controlled by control currents applied to amplitude contour generator 28. By controlling the rise and decay times, the time constant of the contoured control voltage is established. Moreover, various special effects can be achieved by these control voltages, such as the sustaining of a note.

Likewise the filter control signal, routed either to the band-pass filter or the low-pass filter by the V.C.F. contour routing current from resistor matrix 40, is "contoured", as shown at 72 so that the associated frequency rises and falls, or rises, is sustained at a given frequency, and falls. The rise and fall rates are determined by control currents.

Thus tremendous tonal flexibility is achieved through the use of contoured voltage control of the voltage-controlled elements in the sound producing chain.

STEADY STATE CONTROL

The filter contour generator, amplitude contour generator, band-pass filter control circuit, low-pass filter control circuit, and function generator circuit all respond to a series of constant currents which are generated by the resistor matrix 40 in response to signals from a switching unit 42 to which is coupled a direct current power supply 44. The matrix produces eight control currents for continuously variable parameters and four switching supply currents to determine circuit states.

Although some control comes from externally generated voltages, the major steady state control signals applied to the voltage-controlled elements in the sound producing chain and their control circuits are provided by the currents generated through the resistors of the resistor matrix 40. As will be described in connection with FIG. 3, the resistor matrix has 15 input columns and 12 output rows. Selected input columns are connected to selected output rows via single resistors, the values of which determine the requisite steady state control currents. The switching unit 42 provides a predetermined voltage from the power supply 44, which in one embodiment is 9 volts. This voltage is applied to one input column at a time to achieve the desired tone color. With the exception of input columns A and B, the predetermined voltage is applied to one of the remaining 13 input columns, with the other 12 input columns grounded. Input columns A and B provide a one or two-octave transposing capability for the electronic music synthesizer such that the electronic music synthesizer will respond to upward octave shifts by shortening contours and raising filter frequencies.

In addition to the one and two-octave shifts, the resistor matrix provides the following tone colors to the sounds produced by the synthesizer: mute, open, thin, hollow, full, bright, bow, pluck, strike, pick, bell, lunar, and flute. In order to produced these tone colors, the basic eight parameters which are controlled by the resistor matrix are: (1) the center frequency of the band-pass filter, (2) the bandwidth of the band-pass filter, (3) the low-pass cutoff of the low-pass filter, (4–7) the attack and decay times of the amplification and filtering contours, and (8) the oscillator waveform. These parameters are varied by the application of control currents from the output rows of the matrix to low impedance summing points within the synthesizer circuit as will be described in connection with FIG. 4.

The response of the sound producing chain to the application of the supply voltage to one of the 15 input columns of the resistor matrix 40 is illustrated in the following Table. The currents coming out of the output rows of the matrix will be described in connection with FIG. 3.

TABLE I a) All control pots in middle
b) F in middle of KB is depressed.

| | Osc. Waveform | BP Bandwidth 3dB Points | BP Bandwidth Q = Center Frequency/Bandwidth | BP Center Frequency | LP Cutoff (6dB) | Filter Contour Attack Time | Filter Contour Decay Time | Amplifier Contour Attack Time | Amplifier Contour Decay Time |
|---|---|---|---|---|---|---|---|---|---|
| A 2 octaves | | | | up 1 oct. | up 1 oct. | 100% | 100% | 100% | 100% Faster |
| B 1 octave | | | | up ½ oct. | up ½ oct. | 50% | 50% | 50% | 50% Faster |
| C mute | Sawtooth | 1365–881 | 2.4 | 1160 | 5300 | 90 ms | 100 ms | 45 ms | 60 ms |
| D open | Sawtooth | 2530–1010 | 1.0 | 1600 | 11000 | 70 ms | 80 ms | 2 ms | 60 ms |
| E thin | Narrow Relt. | 2140–1230 | 1.7 | 1600 | 3600 | 5 ms | 50 ms | 2 ms | 60 ms |
| F hollow | Square | 3050–1380 | 1.2 | 2030 | 4400 | 50 ms | 50 ms | 2 ms | 60 ms |
| G full | Broad Relt. | 1830–860 | 1.3 | 1280 | 3600 | 5 ms | 100 ms | 2 ms | 60 ms |
| H bright | Narrow Relt. | 8650–2170 | .65 | 4200 | 6800 | 15 ms | 150 ms | 2 ms | 60 ms |
| I bow | Sawtooth | 28K–52 | .043 | 1200 | 6100 | 50 ms | 30 ms | 30 ms | 50 ms |
| J pluck | Narrow Relt. | 100K–187 | .043 | 4300 | | 2 ms | 200 ms | 2 ms | 0.5 s. |
| K strike | Sawtooth | 7300–19 | .043 | 370 | | 2 ms | 250 ms | 2 ms | 1.2 s. |
| L pick | Sawtooth | 1640–890 | 1.7 | 1225 | | 2 ms | 120 ms | 2 ms | 60 ms |
| M bell | Square | 3300–1130 | .85 | 1850 | 600 | 2 ms | 300 ms | 2 ms | 2 s. |
| N lunar | Broad Relt. | 2990–2180 | 3.2 | 2560 | 9800 | 10 ms | 120 ms | 2 ms | 0.6 s. |
| O flute | Square | 1171–343 | .85 | 625 | 2300 | 50 ms | 400 ms | 20 ms | 60 ms |

EXTERNALLY GENERATED VOLTAGES

Simultaneously with the control currents from the resistor matrix, the above-mentioned circuits are provided with externally generated voltages, some of which are mentioned above.

For instance, the bandwidth of the band-pass filter 14 is controlled both by the application of a bandwidth control current from output row #8 of resistor matrix 40 or from an externally generated control current from the emphasis pot 46. As will be described, a current from the emphasis pot provides a means of manually varying the bandwidth of the band-pass filter 14.

Filter contour generator 26 is provided, in addition to the control currents supplied from the resistor matrix 40, with an externally generated repetitive signal from the repeat control voltage unit 48 which causes the filter contour generator to repeat the contoured control voltage for producing repetitive variations in harmonic content. Moreover, in addition to the signals from resistor matrix 40, contour pot 50 controls the time constants of the control voltage generated by the filter contour generated 26 by external adjustment of the attack and decay time.

Likewise, the V.C.A. control circuit 34 is provided with an external volume control signal from a volume pot 52 for controlling the volume produced by the voltage-controlled amplifier 18. Additionally, a sustain key 54 is provided for lengthening the decay time after key release of the amplitude contour, so the the note produced will have a sustained decay curve.

Figure 4:
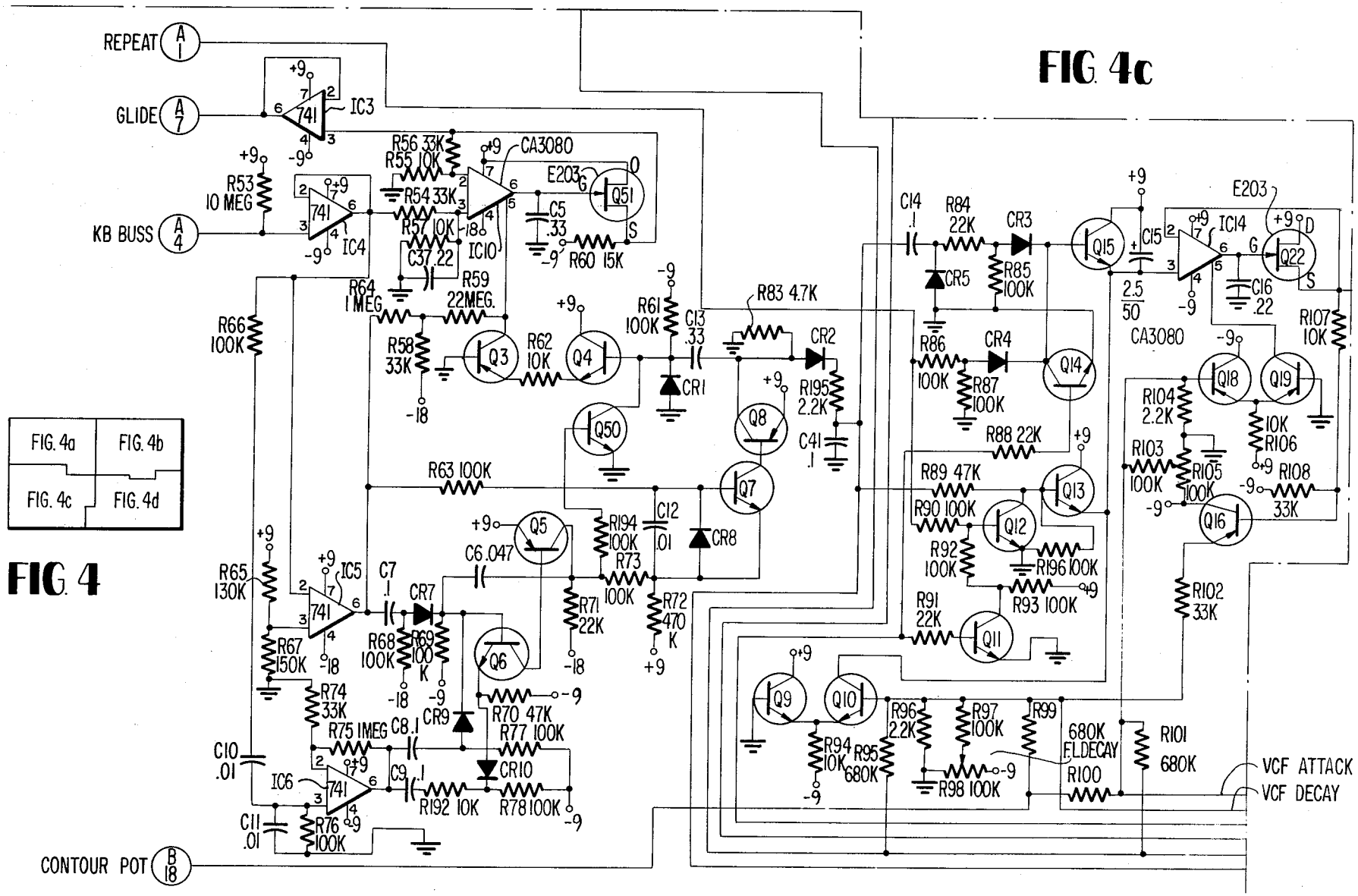
FIG. 4 (i.e. 4*a*, 4*b*, 4*c*, 4*d*) is a detailed schematic diagram of the keyboard circuit, sound producing chain, and the master control circuit for the sound producing chain of FIG. 1.
Figure 4A:
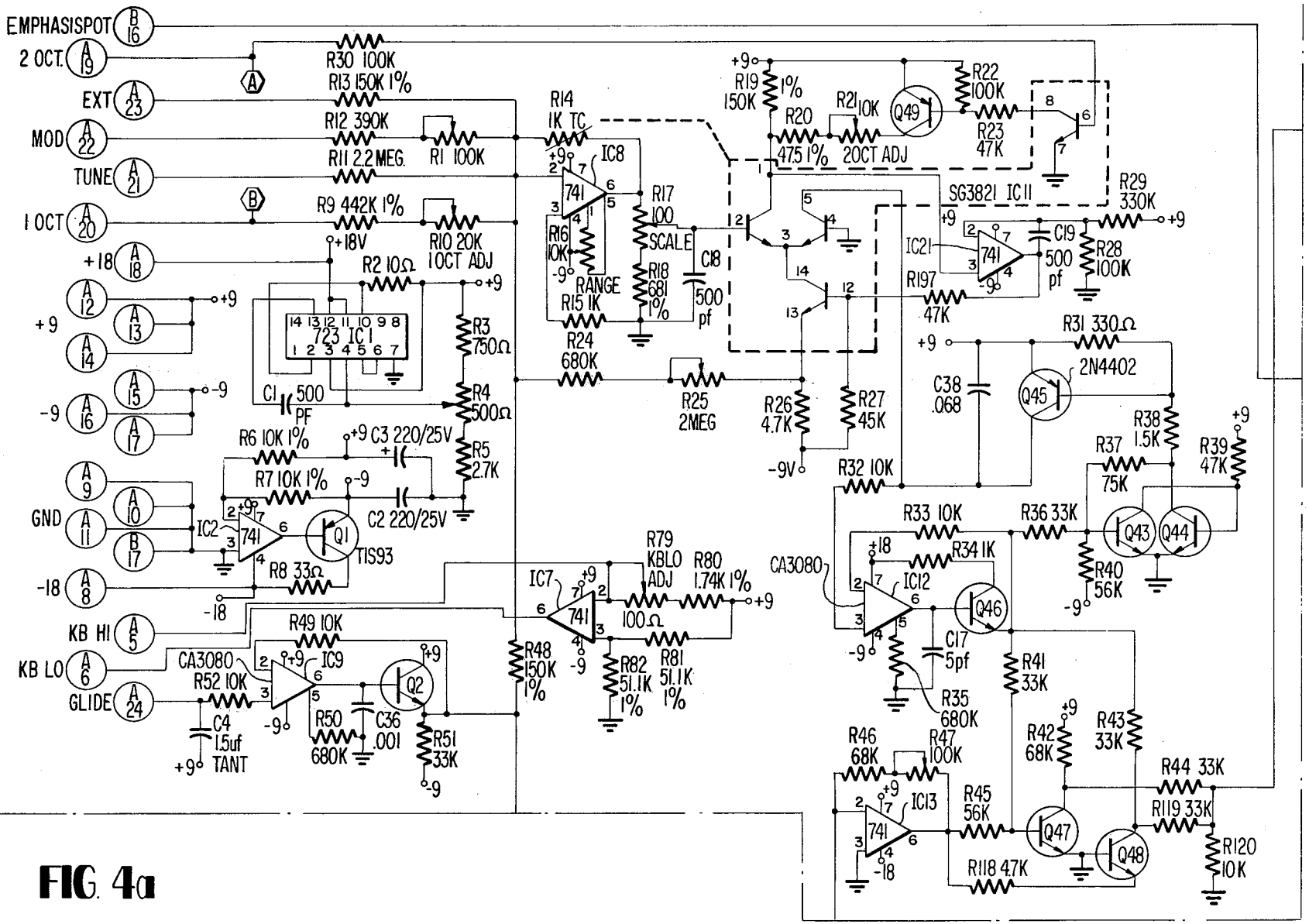

A further external generator illustrated within the box 56 produces signals which can be added to various of the signals from the resistor matrix. These signals are added to the signals from the resistor matrix which control the center frequency and low-pass cutoff frequency of band-pass filter 14 and low-pass filter 16, respectively. Generator 56 provides for an external filtering control signal, a color control signal, and a tremolo control signal applied in parallel with the signals from output rows #7 and #9 as illustrated in FIG. 4. It will be appreciated that the signals from generator 56 directly control the center frequency and the low-pass cutoff frequency in an additive manner with respect to both the control signals generated by the resistor matrix and the filter contour generator.

SUMMARY OF OPERATION

Figure 6:
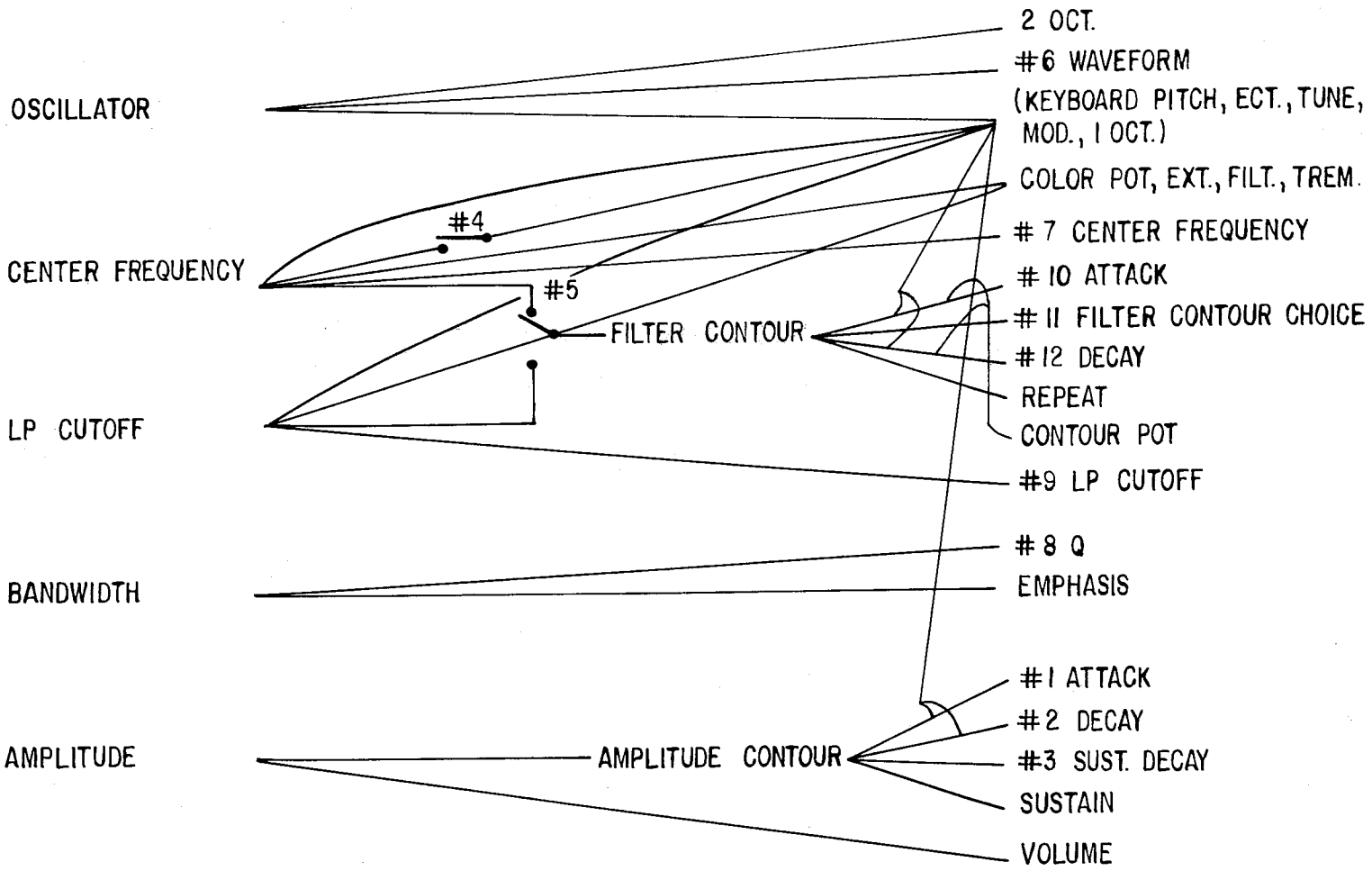
FIG. 6 is a diagram showing how the electrical parameters are controlled in the synthesizer of this invention.

A summary of the complete functioning of the synthesizer is shown in FIG. 6.

As illustrated in FIG. 6, the center frequency is controlled by the keyboard pitch by an amount which depends upon the state of the signal at output row #4 of the resistor matrix. Additionally the center frequency is controlled by output row #7, by the COLOR POT, EXT FILTER, TREM. EXT., MOD inputs, and by the filter contour voltage.

The bandwidth of the band-pass filter is controlled by the output signal on row #8 of the resistor matrix and also by the EMPHASIS POT.

The low-pass filter cutoff is controlled by the COLOR POT, EXT FILTER, TREM., EXT., MOD inputs, the filter contour voltage and the signal at output row #9.

The contour shape of the amplifier control voltage is controlled also by the keyboard pitch signal in combination with the signal from output row #1 which defines the attack and the signal from output row #2 which defines the amplitude contour decay time. Additionally, the output row #3 determines a sustained decay as will be described hereinafter. Finally, with respect to the amplification contour the decay curve thereof may be given a longer decay time after key release via actuation of the sustain key.

With respect to the contour shape of the filter control voltage for either the band-pass filter or the low-pass filter, the keyboard pitch signal is added to the signal from output rows #10 and #12 which control the attack and decay of the filter contour. Additionally, a contour pot provides a control signal which is added to the voltage at rows #10 and #12. An externally generated repeat signal causes the contour signal to be repeated during the production of a note. Additionally, a signal from output row #11 defines a filter contour choice in which the contour voltage may either rise and fall or rise and be maintained at a predetermined level and then fall. Further, the output signal at row #5 determines the filter contour routing. The contour signal is either routed to change the center frequency of the band-pass filter in a predetermined manner or may be routed to the low-pass filter to change the low-pass cutoff frequency in a predetermined manner. Absent a contour signal, the band-pass filter is controlled by the keyboard pitch signal and a steady state signal from row #7. Absent a contour signal, the low-pass filter is controlled by a steady state signal from output row #9.

The oscillator waveform is controlled by the voltage appearing at output row #6. As will be described, the output waveform is changed from a saw-tooth to a rectangular wave in accordance with the amplitude of the current available at output row #6. The frequency of the oscillator is determined, of course, by the keyboard pitch signal and the TUNE, EXT., and MOD, signals available externally.

Additionally, the oscillator may be made to shift one octave or two octaves according to selected externally generated voltages.

In operation, the depressing of a key in the keyboard 20 causes the keyboard circuit 22 to generate a voltage which is applied through the glide unit 24 to give the voltage a rising characteristic whose time constant may be varied. For each keyboard key depression a voltage is applied to the oscillator and to various components of the synthesizer for the generation of a note. Also for each keyboard depression a trigger signal is generated to reset filter contour generator 26 and amplitude contour generator 28 so that the note produced by the oscillator is appropriately modified. Thus for each note there is a predetermined contour. The oscillator output signal generated is given a predetermined waveform in accordance with the output signal from row #6. This output signal is applied to band-pass filter 14, the bandwidth of which has been set in accordance with the appropriate control signals. In addition, as the note is being played, the center frequency of the band-pass filter is controlled and contoured in accordance with the pitch of the note being played and matrix generated signals. The output signal from the band-pass filter is applied to the low-pass filter for appropriate filtering, again controlled generally by the signals from the resistor matrix. The filtered signal is then applied to the voltage-controlled amplifier 18 which gives the signal the appropriate growth and decay characteristic. The growth and decay characteristic is also controlled in major part by the pitch signal and by voltages from resistor matrix 40. The audio output signal from the voltage-controlled amplifier 18 is thus given a variety of characteristics in accordance with the pitch of the note played, the settings of the switching unit 42, and the settings of the externally generated voltages.

Referring now to FIG. 2, a schematically diagrammed switching unit capable of being used as the switching unit 42 of FIG. 1 is illustrated as having a number of single pole double-throw switches 60. It will be appreciated that the switches are connected in series in such a way that it is only possible for one switch to deliver the supply voltage to its associated matrix column. The switch at the beginning of the series string is connected to a positive voltage which in one embodiment is a regulated DC voltage of 9 volts. FIG. 2 shows switch D to be delivering the regulated voltage to its matrix column; other columns from C to O are off. Input columns A and B which control the one octave and two octave response of the sythesizer are independent of each other and of the states of the other twelve switches.

Referring now to FIG. 3, a resistor matrix suitable for use as resistor matrix 40 of FIG. 1 is illustrated with the values of the resistance elements being as noted. It will be appreciated that these resistance values correspond to the use of a D.C. voltage of 9 volts which is applied selectively to the input columns. All resistance values noted may be plus or minus 10 percent with the exception of the resistance values noted for output row #7 in which selected components are given a plus or minus one percent tolerance. Control currents appear at the output rows of the matrix in response to the application of D.C. voltage to a given input column.

These currents result in the changes in the operating characteristics of the voltage controlled elements in the sound producing chain listed in TABLE I as will be apparent from consideration of the preferred embodiment illustrated in FIG. 4.

Before going into a description of the preferred embodiment illustrated in FIG. 4, to recapitulate, the sound producing chain of the synthesizer consists of an oscillator that produces both saw-tooth and rectangular waveforms, a band-pass filter, a low-pass filter, and a variable gain amplifier. All four of these circuits in the sound producing chain are voltage controlled. The remainder of the circuitry is devoted to producing appropriate control voltages. The keyboard circuit produces one pitch control voltage whose magnitude depends on which key is depressed, and a trigger voltage which is on whenever any of the keys are depressed. The modulating oscillator produces triangular and square waveforms for modulating the oscillator and the filters. Two contour generators produce voltages that rise and then fall each time a key is depressed. One of these sweeps one of the filters, while the other sweeps the amplifier. A resistor matrix determines the average values of the voltage-controlled parameters. The power supply delivers ± 18 volts unregulated, and ± 9 volts regulated.

The resistor matrix has 15 input columns and 12 output rows. A column is on when +9 volts is applied to it, and it is off when it is grounded or open-circuited. The two left-most columns are connected to the "two-octave" and "one-octave" switches, respectively. They shorten the contour times and raise the filter frequencies when they are on. The remaining columns are the quickset voices. Only one of these is on at a time. The rows are fed to low impedance points in the circuitry. Of the 12 matrix output rows, eight supply control currents for continuously variable parameters, while the remaining four supply switching current to determine circuit states.

Referring now to FIG. 4, the positive power supply regulator consists of IC1 and the associated components. This circuitry is completely conventional. It will deliver 55 or 60 milliamperes before the voltage developed across current sense resistor R2 limits the current.

The negative regulated supply circuit consists of IC2, Q1, and associated components. This circuit simply adjusts its output to be the negative of the regulated +9v. No current limiting, other than that supplied by R8, is provided.

The keyboard circuit consists of IC3, IC4, IC5, IC6, IC7, IC9, IC10, and related circuitry. The keyboard itself contains a string of thirty-six 100 ohm resistors. The string is connected between A5 and A6. The current through the resistor string is regulated by IC7 so that the drop across R79 and R80 is exactly 4.5 volts. R79 is set so that the voltage at A6 is exactly −4.5 volts.

The voltage at the keyboard bus is fed to voltage follower IC4. Because of resistor R53, the keyboard bus voltage rises to 7 volts or so when no key is depressed. The output of voltage follower IC4 is then fed to comparator IC5. The output of IC5 swings from +7 to −16 volts whenever the input goes above +4.8 volts. Q5 and Q6 comprise a monostable multivibrator that produces a pulse of approximately 20 milliseconds duration. When the output of IC5 swings positive, a positive spike is fed through C7 and CR7 to the base of Q6, initiating a 20 millisecond pulse. R63, R73 and R72 are proportioned so that Q7 conducts only when the output of IC5 is positive and the output of the monostable (the collector of Q5) is negative. That is, Q7 begins to conduct approximately 20 milliseconds after a key is depressed, and stops conducting as soon as all keys are released. When Q7 conducts, Q8 is turned on, and the voltage at its collector goes from 0 to +9. When this happens, C13 discharges through R61, producing a ramp voltage at the base of Q4 that decreases from +9 to −0.6 in approximately 20 milliseconds. Q4 is an emitter follower that supplies a current through R62 and Q3 to turn on IC10. IC10 and Q51 and associated circuitry comprise a sample-hold circuit. When the current ramp is fed to pin 5 of IC10, the voltage at the source of Q51 rapidly approaches that at the output of IC4. As soon as the base of Q4 drops below 0.8 volts, the bias current being fed to IC10 through Q3 drops to zero, and the voltage at the source of Q51 remains constant. As long as the output of IC5 remains positive (that is, as long as any key is depressed) a very small trickle bias current of approximately 50 nanoamperes flows through R59 so that IC10 is capable of supplying a small current to C5 to keep its voltage constant. As soon as all keys are released, the output of IC5 goes negative and IC10 is virtually completely shut off. Thus, when only one key at a time is depressed, the voltage at the source of Q51 begins to approach the new key voltage approximately 10 milliseconds after the key is depressed, and is brought to be equal to the new key voltage well before the ramp current turning IC10 goes to zero. As long as a key is depressed, the correct voltage at the source of Q51 is maintained by the small trickle current going through R59. When the key is released, the trigger output at the collector of Q8 drops to zero, and the sample-hold circuit no longer samples the keyboard voltage. The 10 millisecond delay supplied by Q5 and Q6 is necessary to bypass the effect of contact bounce during key depression.

IC6 becomes important when two keys are depressed. Any abrupt change in voltage at the output of IC4 is fed through R66 and C10 to the input of IC6. C11 filters out spikes shorter than 1 millisecond or so, that are associated with contact bounce or spurious interference. The resulting rounded pulse is amplified by IC6. When the output of IC6 goes positive, CR9 conducts and also fires Q6. Therefore, a 20 millisecond positive going pulse is produced at the collector of Q5 whenever the keyboard bus voltage changes. While this 20 millisecond pulse is on, the trigger voltage at the collector of Q8 goes to zero. This recharges C13 and also resets the contour generators which will be described later. Thus, when a key is held down and a higher key is depressed, the sample-hold circuit again samples and the trigger is reset. The same happens when that higher key is released. However, if the higher key is held and the lower key is released, nothing will happen since the keyboard bus voltage remains constant. When all keys are released, CR9 conducts and a 20 millisecond pulse appears at the collector of Q5. However, the output of IC5 goes negative, so that when the collector of Q5 again goes negative, Q8 is not reset.

IC3 is a voltage follower. Its output is the voltage of the last key to be depressed. The variable resistor that controls the glide rate is connected between A7 and A24. The time constant of this resistor and C4 determines the glide rate. IC9 and Q2 are another voltage follower. The difference between this voltage follower and IC3 is only in the amount of input current required. IC9 is biased at a low current level so that input current does not result in a pitch error when the glide rate potentiometer is at its maximum resistance. The voltage at the emitter Q2 is the voltage which determines the pitch of the audio oscillator. It is also fed to the filters and contour generators so that as the keyboard voltage goes up the filter frequency also goes up and the contour time constants decrease.

The pitch control apparatus in general thus includes means for comparing the voltage drop across a resistor string with a predetermined reference potential and for generating a signal whenever the voltage drop exceeds the threshold. Means are provided for generating a pulse of limited duration with the pulse being initiated responsively to the generation of a signal from the voltage comparing means. A capacitor is also included and means for substantially instantaneously charging the capacitor and for discharging the capacitor at a predetermined rate when during the presence of a signal from the comparing means the pulse goes negative, the capacitor being charged at a predetermined time after the depression of a key and the discharge of the capacitor producing a negative going ramp. Also included is a means for sampling and holding the voltage drop across the resistor string with the sampling and holding means being actuated by the charging of the capacitor and with the holding of the sampled voltage being held until the key is released. With the release of all keys the signal from the comparing means ceases. The output signal from the sample and hold means provides the appropriate pitch-related voltage such that the effects of contact bounce are eliminated. Moreover, there is provided means for sensing a change in the voltage drop across the resistor string and for coupling a signal to the charging and discharging means for the capacitor to initiate the voltage ramp such that the new voltage drop is sampled and held when a higher key than the one originally depressed is actuated.

IC8 is an operational adder. It adds the pitch, the one-octave transpose voltage, a tuning voltage from the fine tuning potentiometer on the rear panel, a modulating voltage, and the voltage from the external accessory socket. R14 is a temperature-compensating feed-back resistor. The summation constant increases with a temperature coefficient of approximately 3400 parts per million. The relationship between R14 and the input resistors is such that the output of IC8 decreases approximately 20 millivolts for each octave increase in frequency.

The audio saw-tooth waveform is generated by charging C38 from one of the transistors in IC11, then rapidly discharging it through Q45. The current which charges C38 is determined by the voltage difference between pins 2 and 4 of IC11. The ratio of currents through these two transistors in IC11 is proportional to the voltage difference between their bases. The current from pin 1 of IC11 is kept constant via a feedback network. The voltage at pin 1 is compared with the voltage at the junction of R28 and R29. Any voltage difference generates an error signal which changes the total current to the transistor pin 12 in IC11. When the "two-octave" switch is down, or closed, R30 conducts and Q49 is saturated. This effectively places the series combination of R20 and R21 in parallel with R19. The voltage at pin 1 of IC11 is then determined by the current which flows through the parallel resistors R19 and R20-21. When the "two-octave" switch is up, or open, R30 does not conduct, Q49 is open, and R20-21 are out of the circuit. Thus the current from pin 1 of IC11 is one quarter as much when Q49 is open as it is when it is saturated and, for the same voltage difference between the bases, the current from pin 5 is also one quarter as much.

The lower end of C38 is applied to low-current voltage follower IC12-Q46. The voltage at the emitter of Q46 is fed to Schmitt trigger Q43–44. The Schmitt trigger has high hysteresis. When the voltage descends to the point where the Schmitt trigger fires, Q45 is turned on and C38 is rapidly discharged. The Schmitt trigger begins to shut off when the discharge is about $\frac{2}{3}$ complete. Because of the storage time of Q44 and Q45, C38 is fully discharged before Q45 is completely off.

The saw-tooth wave developed at the emitter of Q46 is applied through R41 to the base of Q47 and through R43 to the collector of Q48. Q47 is a high gain amplifier. The width of the rectangular wave that appears at its collector depends on the bias current supplied through R45 from the output of IC13. The control current which is fed to the input of IC13 from the resistor matrix determines the output voltage of IC13. When the control current is zero, Q47 remains saturated throughout the entire saw-tooth cycle. Q48 also remains shut off, and the voltage across R120 is the undistorted saw-tooth. As the control current increases, the voltage at the output of IC13 goes negative. When it is about −1 volt, the current through R118 is enough to completely saturate Q48 and effectively short out the saw-tooth waves. When it is about −3 volts, Q47 begins to conduct on part of the saw-tooth cycle and a narrow rectangular waveform appears at its collector. When the voltage at the output of IC13 is about −9 volts, the clipping of Q47 is symmetrical and a square wave appears at its collector. Thus, the waveform at the junction of R119 and R120 is first a saw-tooth when the control current into IC13 is zero, then changes to a narrow rectangular, then to a broad rectangular, and finally to a square wave as the control current is increased. This waveform is fed to the band-pass filter.

A voltage-controlled oscillator has therefore been provided which normally produces a saw-tooth waveform having a frequency related to the control voltage applied to the oscillator. Moreover, a voltage controlled circuit is provided for engendering a two-octave shift in the output signal frequency of the oscillator and for changing the saw-tooth waveform into a rectangular waveform of a predetermined duty cycle. The oscillator circuit includes a capacitor, means for charging the capacitor and transistor means for discharging the capacitor by the shorting of the capacitor plates. A Schmitt trigger is provided having a high hysteresis for sensing the voltage across the capacitor and for rendering the transistor conductive responsively to the voltage across the capacitor reaching a predetermined level. The means for providing the two-octave shift includes means for charging the capacitor which includes a differential pair of transistors. The charging current across the capacitor is determined by the voltage difference across the differential pair. There is also provided means for maintaining the current through one of the transistors of the differential pair constant and means for decreasing the constant current to one-fourth its initial value responsively to a control voltage for causing a two-octave shift in the frequency of the oscillator due to the difference in charging current applied across the capacitor. The waveform changing circuit includes a high gain clipping circuit to which the saw-tooth wave is applied. Moreover, there is provided voltage-controlled means for changing the clipping circuit clipping level which includes means for inactivating the clipping circuit so that the saw-tooth wave is passed through unaltered.

The band-pass filter consists of IC15, IC16 and IC17, and their associated components. The input signal is fed to IC15 and IC16. IC16 and IC17 are identical integrators which are effectively connected in series. If it were not for IC15, the dual integrator network would produce two poles which would be very near to the imaginary axis. The presence of IC15 moves these poles to the left. Thus, the gains of IC16 and IC17 determine the center frequency of the filter, and the gain of IC15 determines the bandwidth (Q). These gains are set by the bias currents which are fed from transistor pairs Q39–40 and Q37–38, respectively. These transistor pairs may be compared directly to the transistor pair in IC11 which determines the frequency of oscillation. The main difference is that relatively constant current are fed to these transistor pairs through R133 and R129. A precise, wide-range relationship between output current and base-to-base voltage is not required of these transistor pairs. Only reasonable repeatability and the rough approximation of exponential characteristics are needed.

The bandwidth is determined by the voltage difference between the bases of Q37 and Q38. The voltage at the base of Q37 is the result of the bandwidth control currents flowing through R128. An increase of 18.6 mv doubles the bandwidth. There are two sources of bandwidth control current: row #8 of the resistor matrix, and the EMPHASIS potentiometer voltage applied to R121. The center frequency is determined by the voltage difference between the bases of Q39 and Q40. The voltage at the base of Q40 is the result of the center frequency control currents flowing through R134. An increase of 18.6 mv doubles the center frequency. These currents come from row #7 of the resistor matrix, the COLOR potentiometer voltage applied to R193, the EXTERNAL jack voltage applied to R184, the modulation voltage applied to R181, the filter contour voltage applied to R116, and the keyboard pitch voltage applied through R179 and R180. The current from row #4 of the resistor matrix determines whether or not Q25 conducts. When Q25 conducts, it is saturated and shorts out a portion of the keyboard voltage which is routed to control the center frequency.

R130 and R132 are offset adjustments for setting correct values of bandwidth and center frequency respectively. They compensate for transistor offset voltages, resistor variations, and gain variations of IC15, IC16 and IC17.

Thus the voltage-controlled bandpass filter comprises a pair of integrators connected in series, means for supplying a variable control voltage in parallel to the pair of integrators to determine the center frequency of the filter, an amplifier adapted to receive an input signal in which the amplifier is connected in series with the integrators for coupling the input signal to the integrators, and means for supplying a variable control voltage to the amplifier for determining the bandwidth of the filter. It will be appreciated that each of the means for supplying a variable voltage includes a differential pair of current sources including a pair of emitter-coupled transistors with the differential current through the transistors determining the control voltages for the filter.

The output of the bandpass filter is taken from the source of Q41 and applied across the bases of the bottom transistor pair of IC19. This transistor pair and the two immediately above it constitute a low-pass filter whose cutoff frequency is proportional to the standing current. This current is in turn determined by the voltage difference between pin 13 of IC19 and the base of Q33. The voltage at the base of Q33 is the result of cutoff frequency currents flowing through R151. These currents come from row #9 of the resistor matrix, the COLOR potentiometer voltage applied to R186, the EXTERNAL jack voltage applied to R185, the modulation voltage applied to R187, and the filter contour voltage applied through R117. The setting of R139 determines the calibration current through R140. An increase of approximately 18.6 millivolts at the base of Q33 results in a one-octave increase in the cutoff frequency of the low-pass filter.

The transistor pair to the right of the low-pass filter controls the amplitude of the audio waveform by variable transconductance. The current which determines this transconductance is in turn determined by the voltage of pin 12 of IC20, and the resistance between pin 13 and ground. The voltage applied to pin 12 is the amplitude contour voltage, and the resistor from B19 to ground is the 100k volume control potentiometer. IC22 is a differential amplifier, the output of which is the final audio waveform.

Of the two contour generators, the amplitude contour generator is the simplest, so it will be described first. This contour generator consists of Q35, Q36, IC18, transistor pairs Q26–27 and Q28–29, Q30, Q31, and the associated circuitry. When the trigger voltage goes on, Q35 partially discharges C25 so that the emitter of Q35 remains at 5 volts or so. If Q36 is saturated, Q34 does not go on at all. Row #3 in the resistor matrix determines whether or not Q36 is turned on. If Q34 is not turned on, C25 is free to charge again through Q26. The charging current from Q26 is determined by the voltage control which the current from the resistor matrix develops across R189. Thus, the voltage at the emitter of Q35 is a decaying curve if Q36 is on, and a step followed by a decaying curve if Q36 is off. The step and decay provides a sustain function. The rise time of the voltage at the emitter of Q35 is determined only by the ability of Q35 to discharge C25. Typically, this rise time is less than 1 millisecond. The decay time of the amplitude contour is determined by the voltage difference between the bases of Q26 and Q27. The voltage across R189 results from the amplitude contour decay time control currents coming from row #2 of the resistor matrix, the keyboard voltage applied to R199, and the shaping current from R169 and R171 (described below). R190 corrects for transistor offsets and other normal component variations. A voltage increase of 18.6 mv at the base of Q26 cuts the decay time in half.

IC18 and Q32 comprise a voltage follower whose slew rate is proportional to the bias current of IC18. The bias current comes from the collector of Q28 and is determined by the voltage difference between the bases of Q28 and Q29. Thus, since the decay time of an envelope is generally longer than the attack time, the voltage appearing at the source of Q32 has an attack time inversely proportional to the collector current of Q26. The contributions to attack time control are similar to those of decay time control. The quick-set current comes from row #1 of the resistor matrix.

Since Q26 is a nearly ideal current source, the decay slope at the source of Q32 would be a straight line, were it not for the action of Q30. At the beginning of the decay slope, the voltage at the base of Q30 is more positive than the emitter, and Q30 does not conduct. When the base of Q30 goes below −0.6 volts, Q30 acts as an emitter follower. The current through R169 slows down the decay slope. The more negative the base of Q30 goes, the higher is its control current, and the more the decay slope goes down. This gives the decay slope an extended tail and therefore sounds like a more natural exponential decay.

When the voltage at B21 is +9, Q31 is saturated and there is very little current flowing through R171. When the voltage at B21 is zero, Q31 is open and current flows through R170-171 to greatly speed up the decay slope. The "sustain" switch connects B21 to +9 when it is down, and connects it to the trigger line when it is up. As a result, the tone is rapidly squelched when the "sustain" tab is up and the keys are released.

As noted above, the keyboard pitch voltage controls both attack and decay times through R199 and R198 respectively. These times change by a factor of approximately 2.5 over the complete keyboard range.

It will thus be appreciated that a voltage-controlled contour generator has been provided which includes a capacitor and means for continually charging the capacitor, means for connecting one end of the capacitor to the other through a resistive element responsively to a trigger signal such that the voltage at the other end rises in accordance with the resistance of the resistive element, voltage control means connected to the other end of the capacitor for discharging the capacitor through a variable resistance element, whereby the voltage at the other end rises and falls, and voltage follower means including a differential amplifier and a follower-type amplifier in series, the slew rate of the voltage follower means being related to the bias current applied to the differential amplifier, and voltage control means for varying the bias current to the differential amplifier. It will further be appreciated that a shunt circuit is provided which is coupled between the output terminal of the follower-type amplifier and the bias varying means for slowing down the decay curve of the voltage appearing at the output terminal of the follower-type amplifier after the voltage drops to a predetermined level, thereby to give the decay curve generated by the contour generator a more natural exponential decay. Thus means for slowing down the decay curve includes a circuit to shunt current away from the bias varying means. This means includes a second follower-type amplifier having its control electrode connected to the output terminal of the first mentioned follower-type amplifier. The second follower-type amplifier is provided with a conduction characteristic related to the voltage at the output terminal of the first follower-type amplifier such that as the voltage at the output terminal drops below the predetermined level the second follower-type amplifier is rendered conductive to alter the bias to the aforementioned differential amplifier from the bias varying means. Moreover, means are provided for counteracting the effect of the decay curve slow-down means for rapidly squelching the audio signal produced at the output terminal of the voltage-controlled amplifier. The counteracting is accomplished by a transistor which is saturated for removing very little of the shunted current generated by the shunt circuit and which is rendered non-conductive for removing a substantial portion of the current generated by the shunt circuit away from the bias current varying means such that the shunt circuit loses its effectiveness for lengthening the decay. This effectively provides for the original shortened decay curve which, by the appropriate application of control voltages to the bias varying means, can be made quite steep or sharp.

The filter contour generator contains most of the features of the amplitude contour generator. Q15 of the filter contour generator corresponds to Q35 of the amplitude contour generator, Q13 to Q34, and Q12 to Q36. An additional feature of the contour-initiating circuitry is the coupling in of trigger pulses from the modulating oscillator through R86 and R90 to produce repeated filter contours. The "filter contour choice" control current that comes from the matrix row #11 through R88 and R91 determines whether the filter contour will rise and then immediately fall, or fall only upon release of all keys. Q9-10 of the filter contour generator corresponds to Q26-27 of the amplitude contour generator. The current from Q10 determines the decay time of the contour. Similarly, IC14 corresponds to IC18, Q18-19 corresponds to Q28-29, and Q16 corresponds to Q30. R95 and R101 couple the keyboard voltage to the attack and decay control circuits. Finally, the voltage applied to B18 from the contour potentiometer simultaneously varies the attack and decay times of the filter contour. Q22 and Q23 are routing switches; only one is on at a time. The "filter contour routing" control current from matrix row #5 determines whether Q17 is open or saturated. If Q17 is open, then Q21 is also open, and Q24 is saturated. Thus, Q22 is biased on and Q23 is biased off, and the contour is routed to the low-pass filter. On the other hand, if Q17 is saturated, Q23 is biased on and the contour is routed to the center frequency control input of the band-pass filter.

From the foregoing description and drawings it can be seen that all control voltages are applied to the base electrodes of the transistors used in the control circuit. When these transistors are rendered conductive by appropriately applied voltages, the base electrodes drop to ground or near ground potential which makes them low impedance points. This permits accurate determination of current with a known voltage (9v. D.C.) applied to the input columns and a single resistor between columns and rows. Thus with a regulated 9v. D.C. supply, the currents and thus the voltages applied to the transistor bases depend solely on the resistors in the matrix. Single resistor control is therefore possible with values which are easily calculated.

Figure 5:
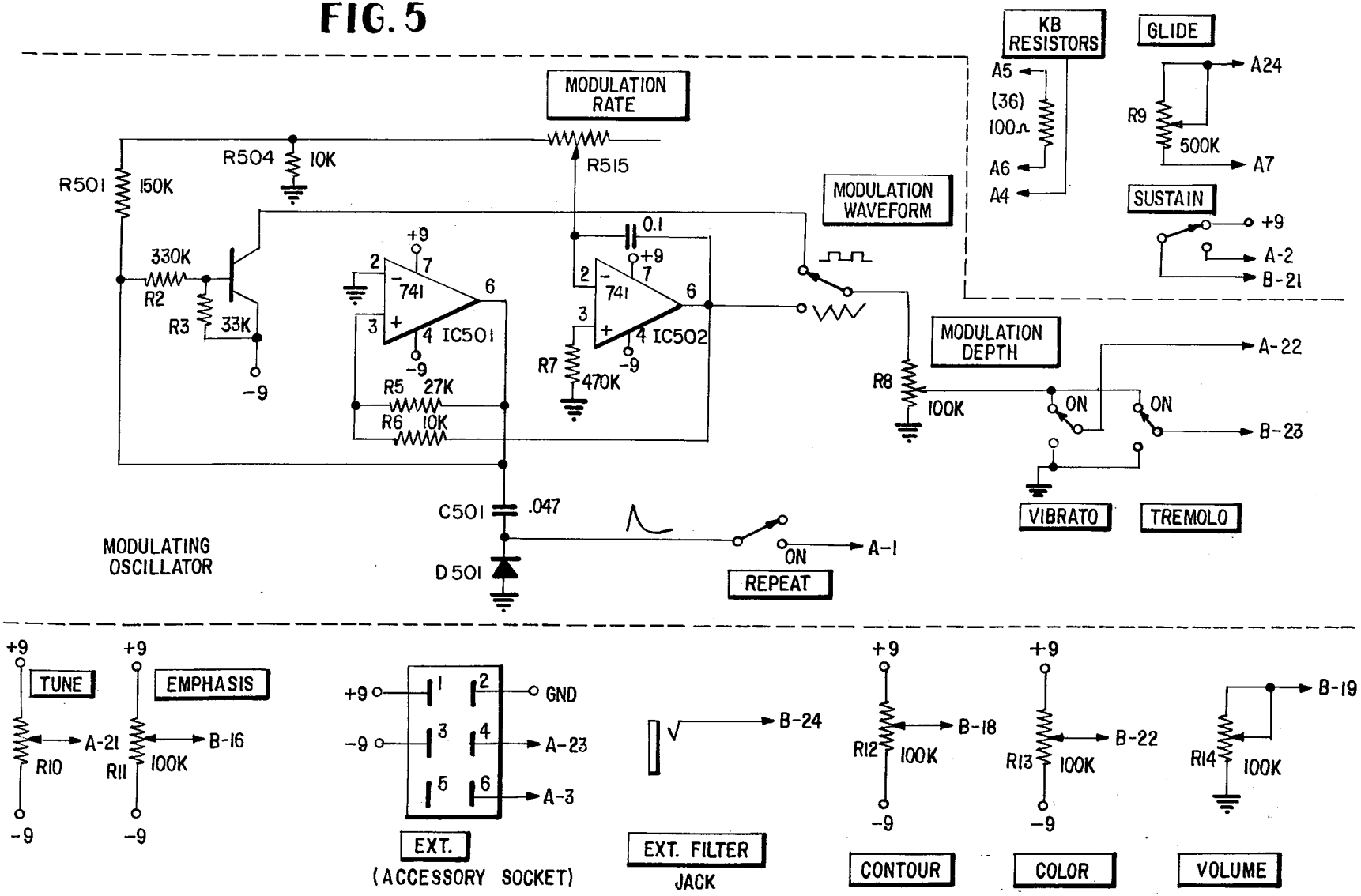
FIG. 5 is a schematic diagram of a circuit for generating the external signals connected to the circuit of FIG. 4.

Apparatus is now described for the supply of the external control voltages to the circuit of FIG. 5.

The modulation oscillator consists of integrator IC502 and Schmitt trigger IC501, arranged in a closed loop. The output of IC502 is a triangular wave, while the output of IC501 is a symmetrical square wave. Voltage divider R501 and R504 followed by variable resistor R515 determine the input current to the integrator, and therefore the frequency of oscillation. Q501 is a transistor switch which is turned on and off by the output of IC501. During a cycle of the modulating oscillator, the voltage at the collector of Q501 goes from 0 down to −9 volts. When the triangular waveform is selected by the modulation waveform switch, effects such as siren, conventional vibrato and conventional tremolo can be created. When the negative-going square wave is selected by the modulation waveform switch, and when the vibrato switch is on, a trill is produced in which the pitch of the higher note is that of the depressed key. The symmetrical square wave at the output of IC501 is differentiated by capacitor C501 and clamped by diode D501, so that a short trigger pulse is produced, which periodically resets the filter contour generator when the repeat switch is on.

Figure 4B:
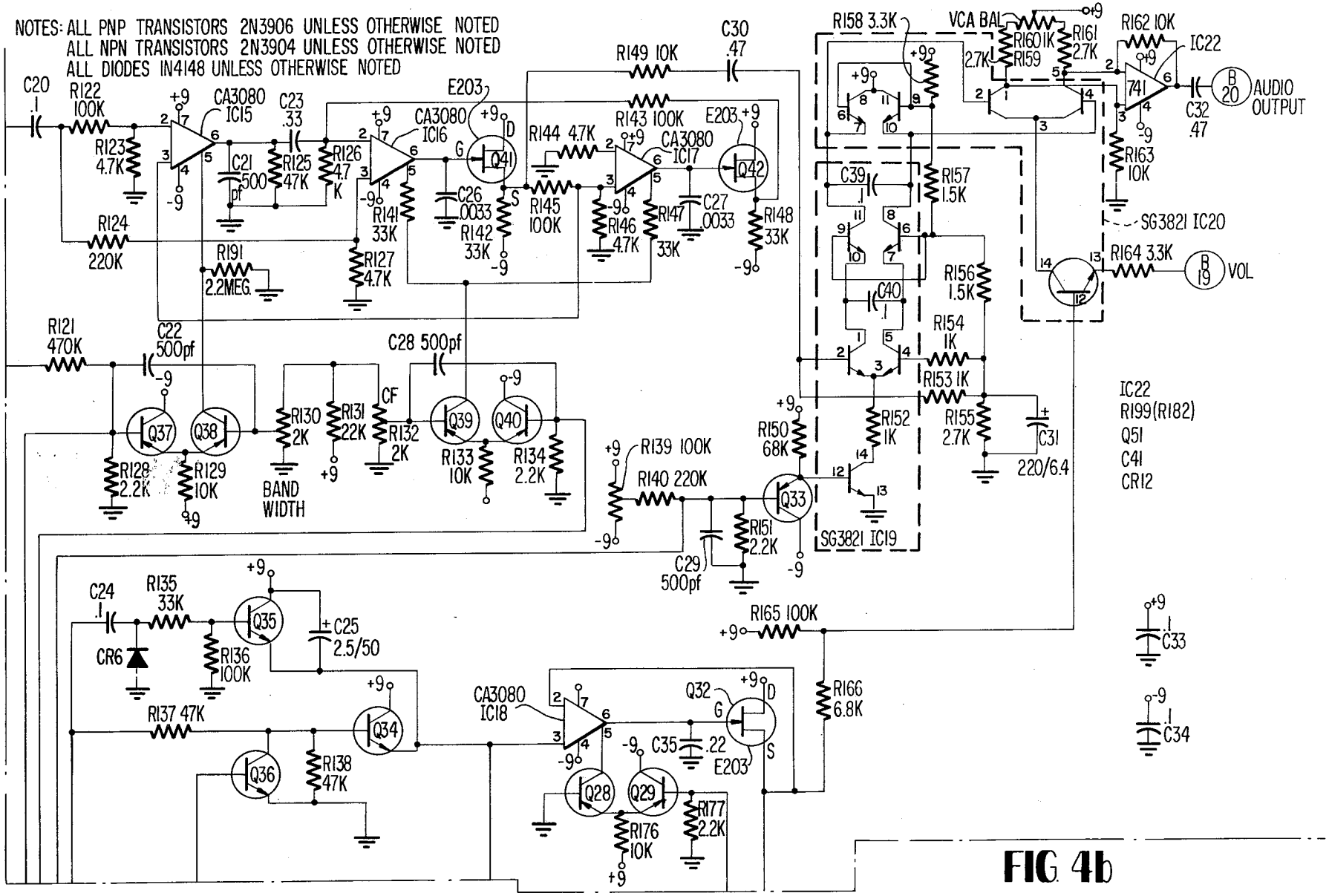
Figure 4D:
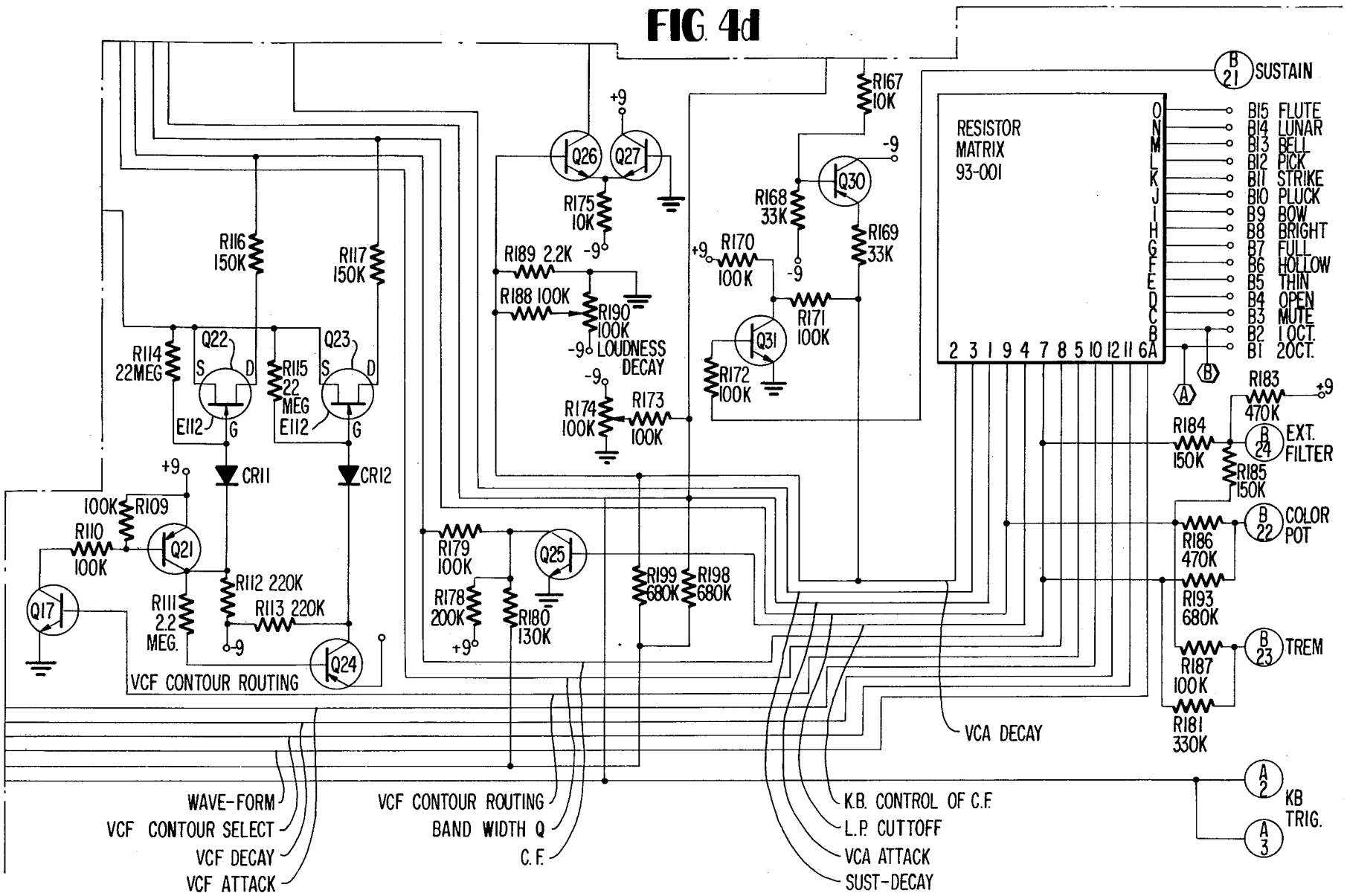

The TUNE, EMPHASIS, CONTOUR and COLOR potentiometers are all connected between +9 and −9 volts. Voltages from their wipers are applied as shown to appropriate points in the circuit. The GLIDE variable resistor is in series with the keyboard voltage storage capacitor, and determines the time constant with which this capacitor charges. The VOLUME variable resistor is in the emitter circuit of the current supply transistor in IC20, FIG. 4B. It determines the maximum amount of current that is fed to the voltage controlled amplifier transistors.

The external accessory socket and external filter jack simply provide mechanical means for introducing externally generated control voltages into the synthesizer.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by United States Letters Patent is:

1. An electronic music synthesizer, comprising:
a sound producing chain having a plurality of voltage-controlled elements;
a low impedance control input for each of said elements;
means coupled between each control input and its respective element for developing a control voltage proportional to the sum of the control currents supplies to the respective input;
means including a resistor matrix coupled to said control inputs for supplying predetermined control currents to said inputs to control the functions of said elements, wherein said matrix comprises a set of rows and a set of columns, means for coupling one of said sets to a source of constant voltage, and means coupling the other of said sets to said control inputs; and
means coupled to said inputs for supplying pitch-related control currents to said control inputs in parallel with said resistor matrix.

2. An electronic music synthesizer comprising a sound producing chain having a plurality of voltage-controlled elements, a low impedance control input for each of said elements, means coupled between each control input and its respective element for developing a control voltage proportional to the sum of the control currents supplied to the respective input, and means including a resistor matrix coupled to said control inputs for supplying predetermined control currents to said inputs to control the functions of said elements.

3. A synthesizer according to claim 2 wherein said matrix comprises a set of rows and a set of columns, means for coupling one of said sets to a source of constant voltage, and means coupling the other of said sets to said control inputs.

4. A synthesizer according to claim 3 wherein the rows and columns of said matrix are interconnected in each instance by a single resistor.

5. A synthesizer according to claim 3 wherein said control voltage developing means includes summing means for producing a control voltage proportional to the sum of the currents supplied to a respective control input.

6. A synthesizer according to claim 5 including means coupled to said inputs for supplying pitch-related control currents to said control inputs in parallel with said resistor matrix.

7. A synthesizer according to claim 2 wherein said elements comprise an oscillator, a bandpass filter, a low pass filter and an amplifier connected in series.

8. A synthesizer according to claim 2 wherein said resistor matrix comprises a predetermined number of input columns and output rows, said output rows being coupled to said control inputs, single resistors between preselected rows and columns, and means coupled to said columns for applying a preselected voltage to one of said columns and for grounding selected other columns.

9. In an electronic music synthesizer means for generating audio signals corresponding to predetermined musical sounds;
a voltage-controlled oscillator for generating an output signal having a frequency proportional to an applied pitch control voltage;
means coupled to said oscillator for applying a pitch control voltage to it;
voltage controlled elements including a voltage controlled band pass filter adjustable in both center frequency and band width by the application of control voltages, a voltage controlled low pass filter having a low pass cut-off frequency adjustable by the application of a control voltage, and a voltage controlled amplifier having a gain adjustable by the application of a control voltage;
means for connecting said voltage controlled elements in series and for applying an oscillator output signal to said band pass filter, an audio output terminal coupled to said series connected voltage controlled elements;
and a master control circuit for generating a number of control voltages applied selectively to said band pass filter, to said low pass filter and to said voltage controlled amplifier for controlling respectively the band width and center frequency of said band pass filter, the low pass cut-off frequency of said low pass filter and the gain of said voltage controlled amplifier, said master control circuit including a resistor matrix having a predetermined number of input columns and a predetermined number of output rows, means for applying a predetermined voltage to an input column and for grounding selected other input columns, resistive elements of preselected values between selected input columns and rows, said rows being connected to low impedance current summing points within said master control circuit, said master control circuit including means for generating said control voltages in response to the currents supplied to said summing points from said resistor matrix.

10. The electronic music synthesizer according to claim 9, wherein said master control circuit includes:
a band-pass filter control circuit; a low-pass filter control circuit; and a voltage-controlled amplifier control circuit; said band-pass filter control circuit generating two output signals, one for controlling the bandwidth of said band-pass filter and the other controlling the center frequency of said band-pass filter, said two output signals being generated responsively to two separate output signals from said resistor matrix; said low-pass filter control circuit generating a third control signal for controlling the low-pass filter cutoff frequency responsively to an additional output signal from said resistor matrix.

11. The electronic music synthesizer according to claim 10 wherein said master control circuit includes:

filter contour control voltage generating means operably coupled in parallel with the center frequency control signal to said band-pass filter control circuit for modifying said center frequency control signal responsively to output signals from selected rows of said resistor matrix and said pitch control voltage, to vary the frequency vs. time contour of the center fequency of said band-pass filter, said filter contour control voltage generating means being selectively disconnected from said band-pass filter and operably connected to said low-pass filter control circuit responsively to a control signal from an output row of said resistor matrix for modifying the low-pass cutoff signal from said resistor matrix in the same manner as the band-pass filter to vary the frequency vs. time contour of said low-pass filter.

12. The electronic music synthesizer according to claim 10 wherein said master control circuit includes amplitude contour control voltage generating means operably connected to said voltage-controlled amplifier control circuit for varying the amplitude contour vs. time characteristic of said voltage-controlled amplifier responsively to output voltages from selected rows of said resistor matrix.

* * * * *